US009224567B2

(12) United States Patent
Henmi

(10) Patent No.: US 9,224,567 B2
(45) Date of Patent: Dec. 29, 2015

(54) RESIN MOLDED PRODUCT

(75) Inventor: Fumitoshi Henmi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 15 days.

(21) Appl. No.: 13/402,158

(22) Filed: Feb. 22, 2012

(65) Prior Publication Data

US 2012/0211480 A1 Aug. 23, 2012

(30) Foreign Application Priority Data

Feb. 23, 2011 (JP) ..... 2011-037345

(51) Int. Cl.
*H01H 85/00* (2006.01)
*H01H 85/52* (2006.01)
*H01H 85/20* (2006.01)

(52) U.S. Cl.
CPC ..... *H01H 85/52* (2013.01); *H01H 85/2005* (2013.01)

(58) Field of Classification Search
CPC ..... H01H 31/127; H01H 85/2045
USPC ..... 337/327; 219/201, 68
See application file for complete search history.

(56) References Cited

U.S. PATENT DOCUMENTS 1,484,198 A * 2/1924 Trent ..... 337/222
1,665,169 A * 4/1928 Holtsclaw ..... 439/366
1,836,890 A * 12/1931 Young ..... 439/476.1
2,004,314 A * 6/1935 Dante ..... 337/215
2,204,299 A * 6/1940 Carlisle ..... 337/284
2,260,457 A * 10/1941 Johnson ..... 337/287
2,571,472 A * 10/1951 Nelson ..... 361/104
2,655,576 A * 10/1953 Milne et al. ..... 337/180
2,777,118 A * 1/1957 Sundt ..... 439/698
2,798,133 A * 7/1957 Curtis ..... 337/177
3,018,349 A * 1/1962 Link ..... 337/180
3,218,517 A * 11/1965 Sankey ..... 361/125

(Continued)

FOREIGN PATENT DOCUMENTS

DE 2 210 407 A 10/1973
JP 3-155018 A 7/1991

(Continued)

OTHER PUBLICATIONS

Communication dated Dec. 24, 2013, issued by the State Intellectual Property Office of the People's Republic of China in corresponding Application No. 201210043807.4.

(Continued)

*Primary Examiner* — David Angwin
*Assistant Examiner* — Lawrence Samuels
(74) *Attorney, Agent, or Firm* — Sughrue Mion, PLLC

(57) ABSTRACT

A resin molded product comprises a fiber to which a metal heating element is attached, a first attaching part that standing upright on a main body of the resin molded product to attach and fix one part of the metal heating element, a second attaching part standing upright on the main body correspondingly to the first attaching part to attach and fix the other part of the metal heating element, and a rib extended continuously and integrally from the first attaching part to the second attaching part and standing upright on the main body, wherein a gate position is provided in the vicinity of the first attaching part on a straight line connecting the first attaching part to the second attaching part in a back side of the resin molded product to set an orientation of the fiber formed in the rib in the extending direction of the rib.

8 Claims, 6 Drawing Sheets

(56) References Cited

U.S. PATENT DOCUMENTS

| | | | | |
|---|---|---|---|---|
| 3,235,688 | A * | 2/1966 | Fink et al. | 337/156 |
| 3,238,330 | A * | 3/1966 | Smith, Jr. | 337/223 |
| 3,366,761 | A * | 1/1968 | Smith, Jr. | 337/10 |
| 3,400,235 | A * | 9/1968 | Howard et al. | 337/229 |
| 3,419,839 | A * | 12/1968 | Matthews | 337/186 |
| 3,715,698 | A * | 2/1973 | Blewitt | 337/166 |
| 3,927,927 | A * | 12/1975 | Salzer et al. | 439/571 |
| 4,713,645 | A | 12/1987 | Razavi | |
| 4,744,010 | A * | 5/1988 | Witte | 361/812 |
| 4,801,278 | A * | 1/1989 | Sappington | 439/746 |
| 6,259,157 | B1 * | 7/2001 | Sakamoto et al. | 257/723 |
| 6,524,116 | B2 * | 2/2003 | Davison et al. | 439/70 |
| 6,867,367 | B2 * | 3/2005 | Zimmerman | 174/528 |
| 6,908,170 | B2 * | 6/2005 | Merz | 347/18 |
| 7,671,382 | B2 * | 3/2010 | Sudo et al. | 257/181 |
| 7,989,704 | B2 * | 8/2011 | Bessede et al. | 174/139 |
| 2005/0008929 | A1 | 1/2005 | Brede et al. | |
| 2005/0277351 | A1 * | 12/2005 | Smith et al. | 442/110 |
| 2005/0277721 | A1 * | 12/2005 | Smith et al. | 524/430 |
| 2005/0280496 | A1 * | 12/2005 | Almgren et al. | 337/202 |
| 2006/0234576 | A1 * | 10/2006 | Smith et al. | 442/110 |
| 2007/0138624 | A1 * | 6/2007 | Sudo et al. | 257/706 |
| 2008/0050580 | A1 * | 2/2008 | Stevens et al. | 428/327 |
| 2008/0262128 | A1 * | 10/2008 | Stevens et al. | 523/400 |
| 2008/0296046 | A1 * | 12/2008 | Bessede et al. | 174/139 |
| 2009/0184796 | A1 * | 7/2009 | Heller | 337/168 |

FOREIGN PATENT DOCUMENTS

| | | | |
|---|---|---|---|
| JP | 8-142213 | A | 6/1996 |
| JP | 2005-276494 | A | 10/2005 |

OTHER PUBLICATIONS

Office Action, dated Jul. 14, 2014, issued by the State Intellectual Property Office of the People's Republic of China in counterpart Chinese Application No. 201210043807.4.

Office Action, Issued by the German Patent- and Trademark Office, Dated Nov. 26, 2014, in counterpart German application No. 10 2012 101 442.6.

Office Action, Issued by the Japanese Patent Office, Dated Sep. 2, 2014, in counterpart Japanese Application No. 2011-037345.

* cited by examiner

FIG. 6 (A) (1)
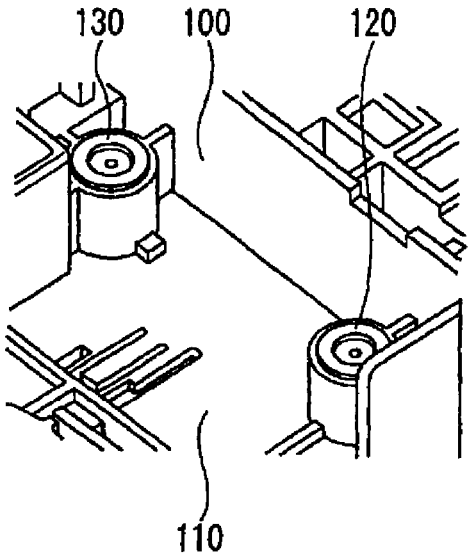
FIG. 6 (A) (2)
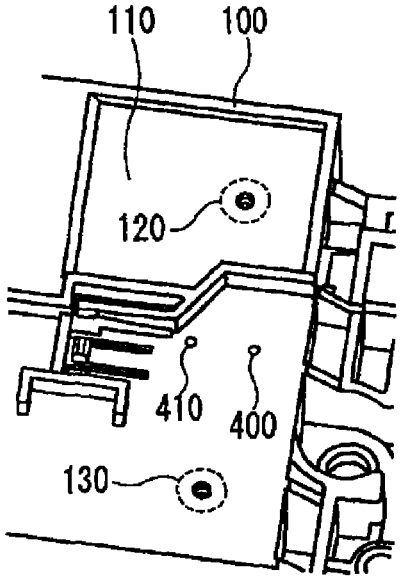
FIG. 6 (B) (1)
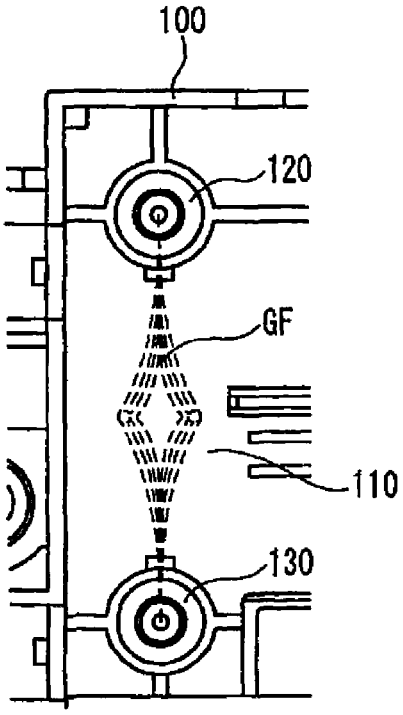
FIG. 6 (B) (2)
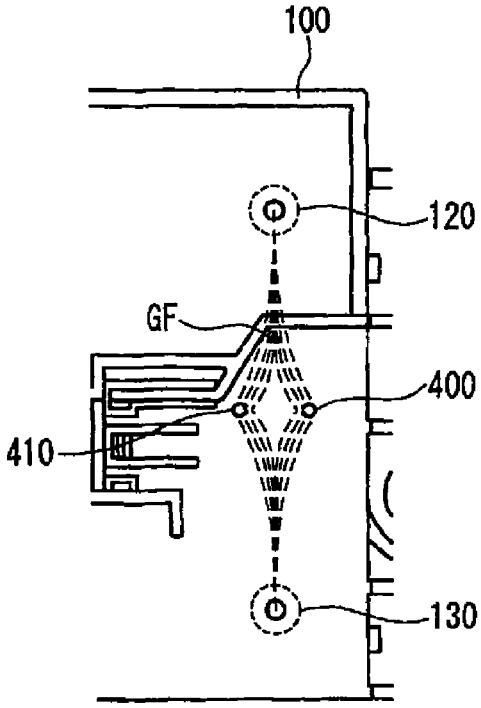

RESIN MOLDED PRODUCT

BACKGROUND OF THE INVENTION

1. Field of the Invention

The present invention relates to a resin molded product to which a metal heating element such as a fuse is attached.

2. Description of the Related Art

<Resin Molded Product Disclosed in PTL 1>

A fuse is ordinarily attached to a resin molded product (see PTL 1). FIG. 5 is an exploded perspective view of a resin molded product described in the patent literature 1 and shows a fuse holder and a fuse. In FIG. 5, to a first attaching part 120S and a second attaching part 130S provided in a holder main body 110S of the fuse holder 100S as the resin molded product, both ends of the fuse 200S as a metal heating element are attached and fixed by using bolts 300S.

PTL 1: JP-A-2005-276494

<Problems of Resin Molded Product Described in PTL 1>

There is a large difference in a coefficient of linear expansion between the fuse holder 100S formed with a synthetic resin and the fuse 200S formed with metal. Ordinarily, the coefficient of linear expansion of the fuse holder 100S is larger by 10 to 19 or so than that of the fuse 200S. Accordingly, a problem arises that an elongation of the fuse holder 100S is larger than an elongation of the fuse 200S at high temperature, and even under no state of over-current, the fuse 200S is forcibly pulled by the fuse holder 100S so that the fuse is cut.

<Resin Molded Product of Advanced Invention>

Thus, the applicant of the present invention develops, as means for solving the problems of the invention disclosed in the PTL 1, a resin molded product which can prevent a fuse from being cut due to the difference in a coefficient of linear expansion as an advanced invention. FIG. 6 shows the resin molded product according to the advanced invention. FIG. 6(A)(1) is a front perspective view and FIG. 6(A)(2) is a back perspective view. FIG. 6(B)(1) is a front view and FIG. 6(B)(2) is a back surface view. In FIG. 6, the resin molded product 100 of the advanced invention is formed with a synthetic resin including glass fibers. As shown in FIG. 6(A)(1), on a front side of the resin molded product 100, a first attaching part 120 and a second attaching part 130 for attaching a fuse are provided so as to stand upright on a main body 110. Two gate positions 400 and 410 which form the resin molded product 100 are provided in a back side of the resin molded product 100 so as to be located substantially at an intermediate part of a straight line that connects the first attaching part 120 to the second attaching part 130 and linearly symmetrically come close to each other (see FIG. 6(A)(2)). Further, since the resin molded product 100 includes the glass fibers, the orientation of the glass fibers GF that appears along a flowing direction of the resin is formed in directions shown by FIGS. 6(B)(1) and 6(B)(2). When the resin having the glass fibers is used, a thermal resistance is high and a plastic deformation of the resin molded product 100 due to the heat of the fuse can be prevented. Further, since most of the orientation of the glass fibers is directed to a direction that connects the first attaching part 120 to the second attaching part 130 for attaching the fuse, a coefficient of linear expansion of the resin molded product is close to a coefficient of linear expansion of the fuse. Thus, the number of times that the fuse is cut is reduced.

Problems in Advanced Invention

As described above, since the resin having the glass fibers is used and the two gate positions 400 and 410 are provided so as to be located substantially at the intermediate part of the straight line that connects the first attaching part 120 and the second attaching part 130 and linearly symmetrically come close to each other, the plastic deformation of the resin molded product 100 can be prevented and the number of times that the fuse is cut is reduced. However, it is insufficient for the fuse to be completely prevented from being cut because of a reason as described below. When the orientation of the glass fibers GF is set to the same direction as an attaching direction of the fuse, the difference between the coefficient of linear expansion of the fuse and the coefficient of linear expansion of the resin molded product 100 is reduced. However, it is recognized that since the gate positions 400 and 410 are linearly symmetrically provided with respect to the straight line that connects the first attaching part 120 to the second attaching part 130, when the glass fibers still exist among the glass fibers whose orientation is directed to a direction at right angles to the straight line that connects the gate positions together, these glass fibers have the coefficient of linear expansion of the resin.

Further, since the gate positions 400 and 410 are provided so as to come close to each other, the form of that part is liable to be deformed due to a molding pressure during a molding operation or a warp of the resin molded product 100 after the molding operation. Further, as can be understood, a problem arises that the number of gates is increased to increase a cost.

The present invention is devised by considering the above-described circumstances and it is an object of the present invention to provide a resin molded product for attaching a metal heating element made of metal such as a fuse, which is formed with a synthetic resin including fibers such as glass and can prevent the metal heating element from being cut or a deterioration of the resin occurring in the vicinity of the metal heating element by forming the orientation of the fibers to be substantially parallel to an attaching direction of the metal heating element.

SUMMARY OF THE INVENTION

In order to achieve the above-described object, a resin molded product according to the present invention is characterized by below-described (1) to (3).

(1) A resin molded product, comprises a fiber to which a metal heating element is attached, a first attaching part that stands upright on a main body of the resin molded product to attach and fix one part of the metal heating element, a second attaching part that stands upright on the main body correspondingly to the first attaching part to attach and fix the other part of the metal heating element, and a rib that is extended continuously and integrally from the first attaching part to the second attaching part and stands upright on the main body, wherein a gate position is provided in the vicinity of the first attaching part on a straight line that connects the first attaching part to the second attaching part in a back side of the resin molded product to set an orientation of the fibers formed in the rib in the extending direction of the rib.

(2) A resin molded product of the above-described (1), wherein the rib passes through the main body and stands upright on a back side of the main body, grooves are provided at both sides of the rib and the rib is formed to be thicker than the main body and the grooves.

(3) A resin molded product according to the above-described (1), wherein a plurality of auxiliary ribs are provided in directions orthogonal to the extending direction of the rib.

According to the structure of the above-described (1), since the fibers are included in a synthetic resin for forming the resin molded product, and an attaching direction of the metal heating element attached and fixed between the first attaching part and the second attaching part, an orientation of the fibers formed in the rib and the gate position are provided on the straight line that connects the first attaching part to the second attaching part so that they correspond mutually, a difference between a coefficient of linear expansion of the metal heating element and a coefficient of linear expansion of the rib can be reduced to avoid the fuse from being cut.

According to the structure of the above-described (2), since the rib is formed to be thicker than the main body or the grooves, the resin rapidly flows in the rib during a molding operation of the rib so that a parallel orientation of the fibers in the rib may be more improved.

According to the structure of the above-described (3), since the plurality of auxiliary ribs are provided, the strength of the resin molded product is increased and durability is improved.

BRIEF DESCRIPTION OF THE DRAWINGS

FIG. 1(A) is a front perspective view and FIG. 1(B) is a back perspective view.

FIG. 2(A) is a front view and FIG. 2(B) is a back surface view.

FIG. 3(A) is a front perspective view and FIG. 3(B) is a back perspective view. FIG. 3(C)(1) is a front view and FIG. 3(C)(2) is a back surface view.

FIG. 4(A) is a sectional view taken along a line A-A in FIG. 3(A).

FIGS. 6(A)(1) and (A)(2) show a resin molded product according to the advanced invention of the present invention. FIG. 6(A)(1) is a front perspective view and FIG. 6(A)(2) is a back perspective view. FIG. 6(B)(1) is a front view and FIG. 6(B)(2) is a back surface view.

DESCRIPTION OF THE PREFERRED EMBODIMENTS

Now, a preferred exemplary embodiment of a resin molded product according to the present invention will be described below.

First Exemplary Embodiment of the Present Invention

Structure of Resin Molded Product According to First Exemplary Embodiment

Figure 1:
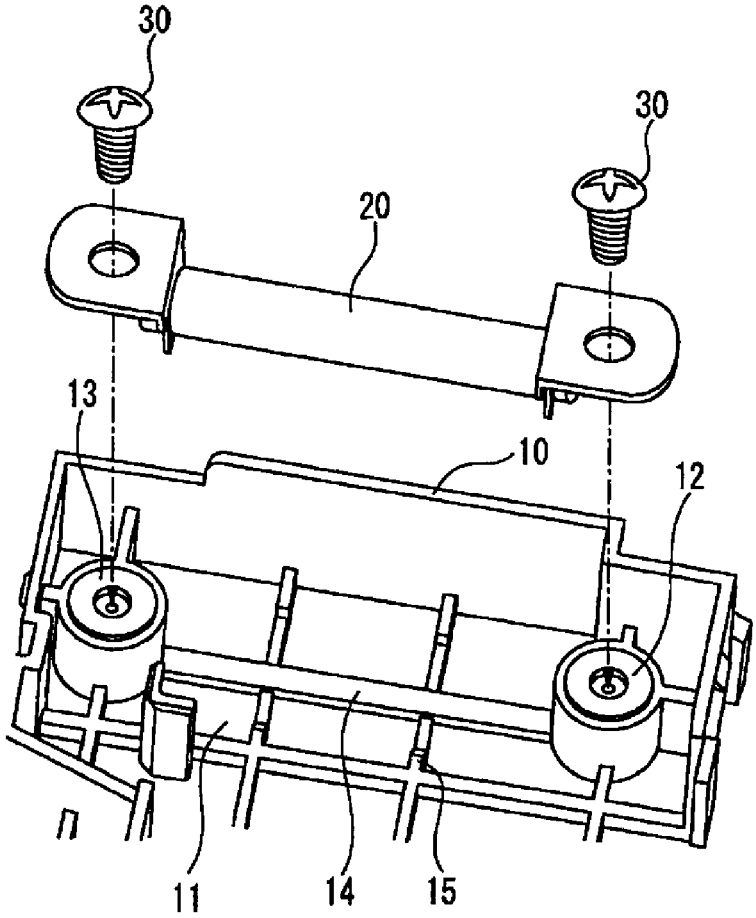
FIGS. 1 (A) and (B) show a first exemplary embodiment of a resin molded product according to the present invention.
Figure 1:
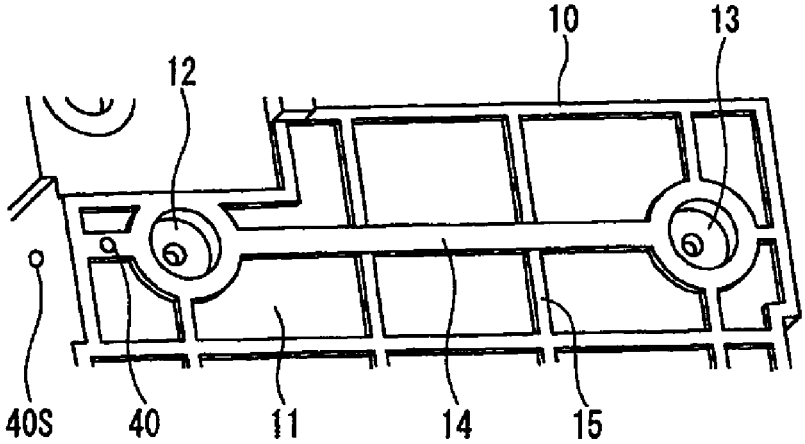

FIG. 1 shows a first exemplary embodiment of a resin molded product according to the present invention. In FIG. 1(A), the resin molded product 10 of the first exemplary embodiment is formed with a synthetic resin including fibers such as glass fibers, alumina fibers, carbon fibers or the like. In a front side of the resin molded product 10, a first attaching part 12 and a second attaching part 13 standing upright from a main body 11 are provided so as to correspond to each other. To the first attaching part 12 and the second attaching part 13 respectively, both ends of a metal heating element 20 such as a fuse or a heater are respectively attached and fixed by screws 30.

Between the first attaching part 12 and the second attaching part 13, a substantially rectangular rib 14 is provided which stands upright toward the front side from the main body 11. The rib 14 standing upright has a height smaller than a height of the first attaching part 12 and larger (thick) than that of the main body 11, is formed with a width and extended continuously and integrally from a bottom part of the first attaching part 12 to the second attaching part 13 and stands upright to a bottom part of the second attaching part 13. In a periphery of the rib 14, a plurality of auxiliary ribs 15 which improve the strength of the resin molded product 10 are provided continuously and integrally in the directions orthogonal to the extending direction of the rib 14 from a side surface of the rib 14.

FIG. 1(B) is a back perspective view seen from a back side of the resin molded product 10.

The first attaching part 12, the second attaching part 13, the rib 14 and the auxiliary ribs 15 also respectively stand upright on the back side of the resin molded product 10. Namely, the first attaching part 12, the second attaching part 13, the rib and the auxiliary ribs 15 are respectively provided in such a form that they pass through the main body 11. Especially, it is important that the rib 14 is formed so as to be thicker than the main body 11 and have a prescribed width. Reference numeral 40 designates a gate position for forming the resin molded product 10. The gate position 40 is provided in the vicinity of the first attaching part 12 on a straight line that connects the first attaching part 12 to the second attaching part 13. A specific position shown in FIG. 1(B) where the gate position 40 is arranged is located in one side part of the attaching part 12 (indicates a side part corresponding to the rib 14 with the first attaching part 12 sandwiched between the side part and the rib).

Further, as another form of the gate position 40, a gate position 40S may be provided on a standing wall of the resin molded product 10.

<<Orientation of Resin Molded Product in the Present Invention>>

Figure 2:
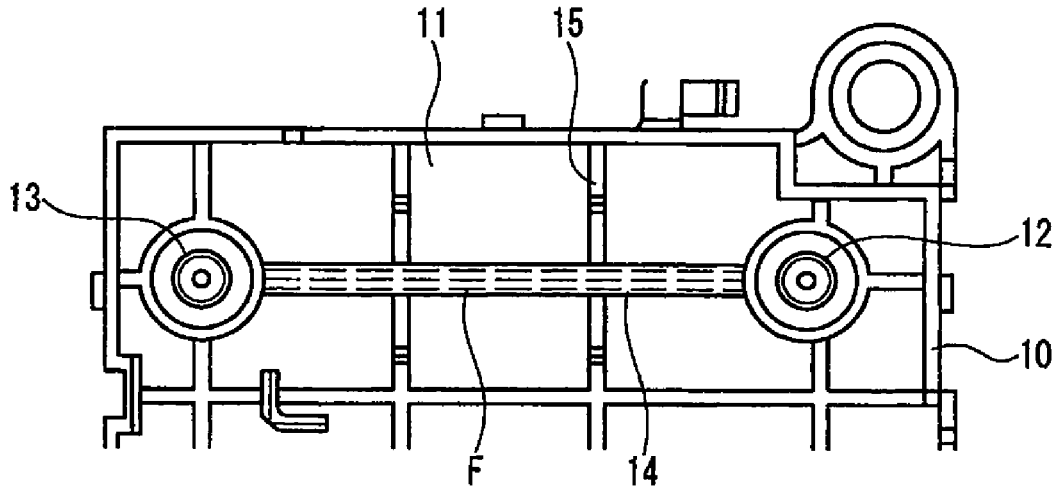
FIGS. 2 (A) and (B) show the resin molded product shown in FIG. 1.
Figure 2:
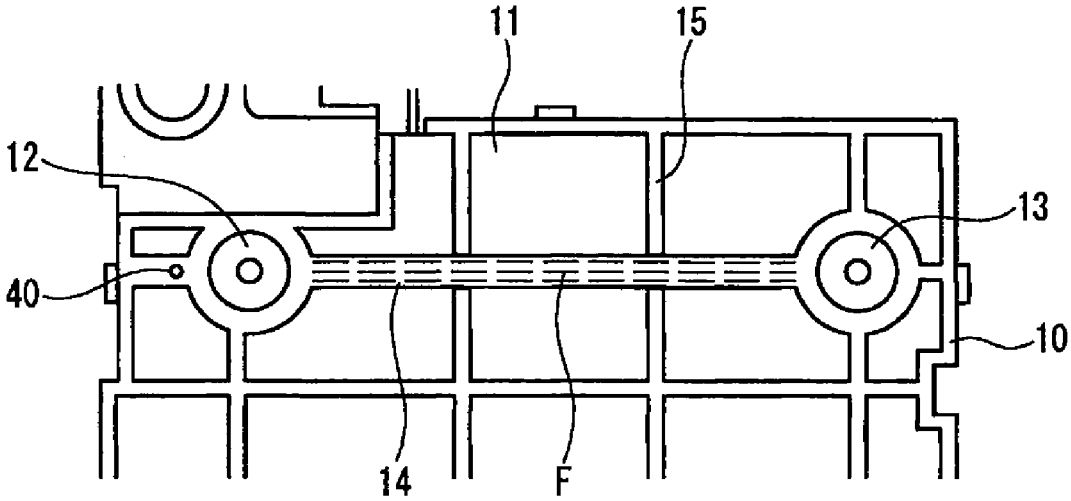

Now, an orientation of the fibers in the resin molded product 10 will be described by referring to FIG. 2.

The fiber is designated by a symbol F. The resin injected to a metal mold from the gate position 40 (or 40S) flows from the first attaching part 12 to the second attaching part 13 through the rib 14. Since the rib 14 is formed to be thicker than the main body 11, the velocity of the resin flowing in the rib 14 is higher than that in the main body 11. Thus, the orientation of the fibers F can be set to be substantially parallel to the extending direction of the rib 14. Namely, since the extending direction of the rib 14 corresponds to the attaching direction of the metal heating element 20, the attaching direction of the metal heating element 20 corresponds to the parallel orientation of the fibers F. Further, since a sectional form of the rib 14 is provided to be the same over an entire part of the rib 14, the flow velocity of the resin is uniform to obtain a high-degree orientation.

Since the parallel orientation of the fibers F formed in the rib 14 of the resin molded product 10 substantially corresponds to the extending direction of the rib 14, a coefficient of linear expansion in the rib 14 can be more reduced than that obtained when the orientation of the fibers F is set to be orthogonal to the extending direction of the rib 14. As a result, a difference between the coefficient of linear expansion of the rib 14 and the coefficient of linear expansion of the metal heating element 20 is reduced so that the metal heating element 20 may be restrained from generating heat to elongate the rib 14 more than the metal heating element 20 and the metal heating element 20 may be prevented from being cut. Further, a thermal deterioration or a plastic deformation of the rib 14 or a part in the vicinity of the rib 14 can be suppressed and prevented in cooperation with the auxiliary ribs 15.

Second Exemplary Embodiment of the Present Invention

Figure 3:
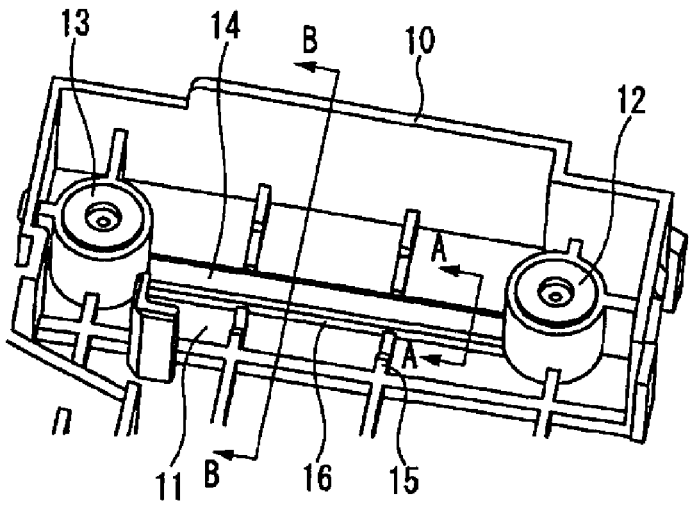
FIGS. 3 (A), (B), (C)(1) and (C)(2) show a second exemplary embodiment of a resin molded product.
Figure 3:
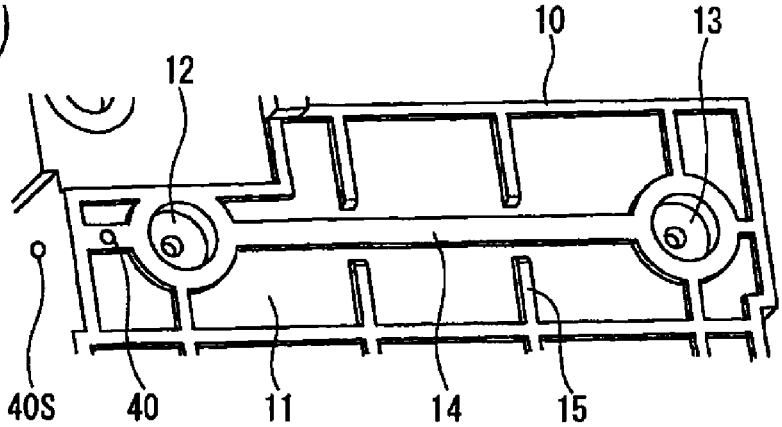
Figure 3:
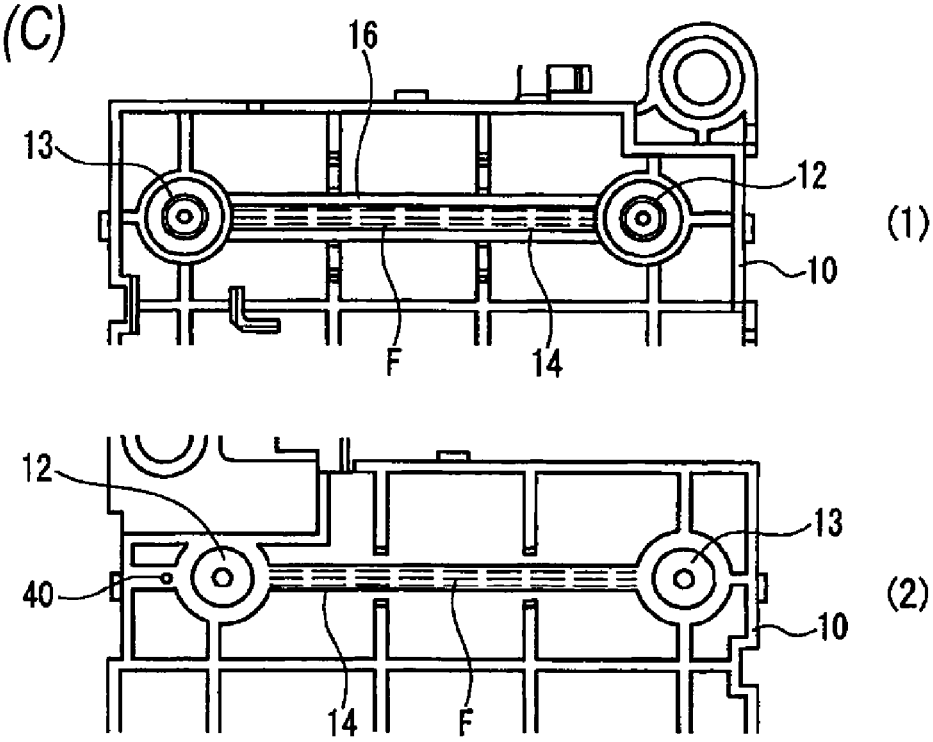

Now, a second exemplary embodiment of the present invention will be described by referring to FIG. 3.

At both sides of a rib 14 provided in a front side (see FIG. 3(A)) of a resin molded product 10, grooves 16 are respectively provided and a plurality of auxiliary ribs 15 that improve a strength of the resin molded product 10 are provided through the grooves 16 so as to be orthogonal to an extending direction of the rib 14. Namely, the auxiliary ribs 15 are separated from the rib 14 and formed from side parts of the grooves 16.

In a back sided (see FIG. 3(B)) of the resin molded product 10, the first attaching part 12, the second attaching part 13, the rib 14 and the auxiliary ribs 15 respectively stand upright toward the back side from a main body 11 similarly to the first exemplary embodiment. Further, as in the front side of the resin molded product 10, the auxiliary ribs 15 are formed to be separated from the rib 14.

A parallel orientation of fibers F formed in the rib 14 is shown in FIG. 3(C). In accordance with the above-described structure of the second exemplary embodiment, the parallel orientation of the fibers F formed in the rib 14 is more uniform and stable than that of the first exemplary embodiment.

<Orientation of Resin Molded Product According to Second Exemplary Embodiment>

Figure 4:
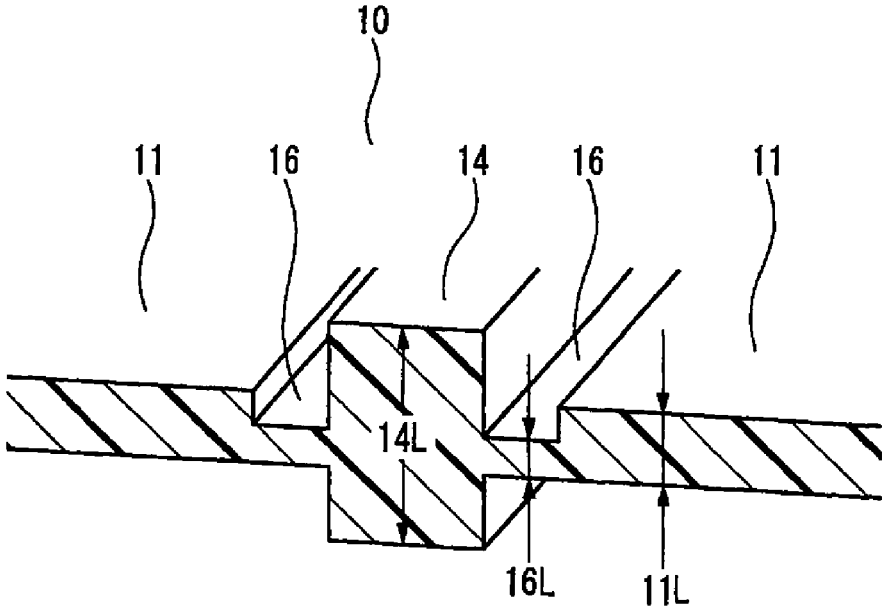
FIGS. 4(A) and (B) show the resin molded product shown in FIG. 3.
FIG. 4(B) is a sectional view taken along a line B-B in FIG. 3(A).
Figure 4:
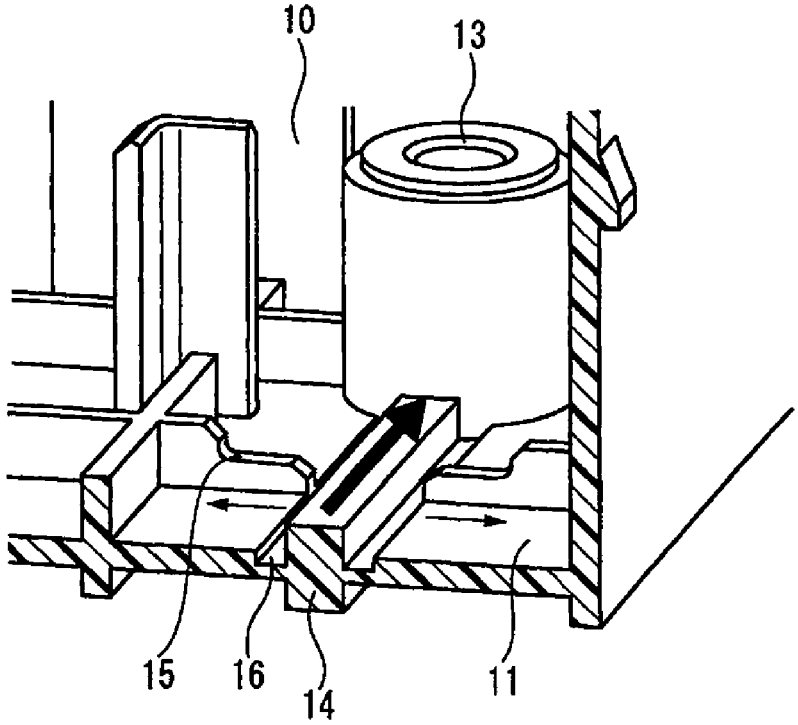
Figure 5:
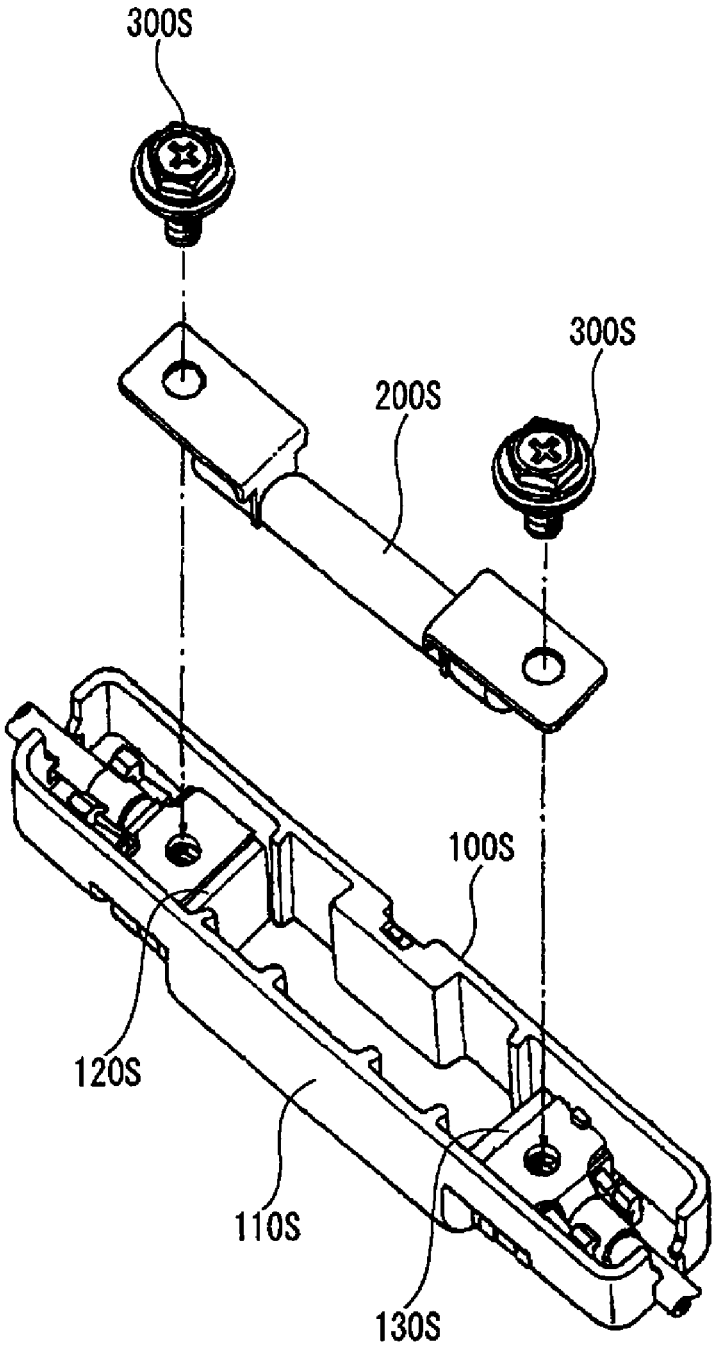
FIG. 5 is an exploded perspective view of a resin molded product disclosed in patent literature 1.

FIG. 4(A) is a sectional view taken along a line A-A in FIG. 3(A) showing the resin molded product according to the second exemplary embodiment. FIG. 4(B) is a sectional view taken along a line B-B in FIG. 3(A).

The rib 14 is formed to be thicker than the grooves 16. Namely, a height 14L of the rib 14 is formed to be larger than a height 16L of the grooves 16 provided at both the sides of the rib 14 (14L>16L). Further, the grooves 16 are formed to be thinner than the main body 11. Namely, the height 16L of the grooves 16 is formed to be smaller than a height 11L of the main body 11 (16L<11L). Accordingly, a relation expressed by 14L<11L<16L is established.

During a molding operation of the resin molded product 10, owing to a large difference in dimensional form, a resin injected to a metal mold from a gate position (or 40S) rapidly flows toward the second attaching part 13 in the rib 14 (an arrow mark shown by a thick line in FIG. 4(B)), and flows slowly in a direction at right angles to the direction of the rib 14 (an arrow mark shown by a thin line in FIG. 4(B)). Especially, since the grooves 16 are thinner than the main body 11, the flow velocity of the resin forming the rib 14 is high and stable. Accordingly, the parallel orientation of the fibers F is improved.

Further, since the auxiliary ribs 15 orthogonal to the rib 14 are formed to be lower in the vicinity of the grooves 16 in the direction of height than other parts, the parallel orientation of the fibers F is more stabilized.

Brief of the Present Invention

In the above-described resin molded product 10 according to the present invention which is formed with the synthetic resin including the fibers F such as the glass fibers, the first attaching part 12 and the second attaching part 13 to which the metal heating element 20 such as the fuse is attached and fixed are allowed to stand upright on the main body 11. The rib 14 is allowed to stand upright which is extended continuously and integrally from the first attaching part 12 to the second attaching part 13. The orientation of the fibers F formed in the rib 14 is allowed to substantially correspond to the extending direction of the rib 14.

Accordingly, the difference between the coefficient of linear expansion of the metal heating element 20 and the coefficient of linear expansion of the rib 14 can be reduced. When the difference in a coefficient of linear expansion is reduced, the metal heating element 20 can be prevented from being cut, which occurs when the metal heating element 20 generates heat, and the thermal deterioration or the plastic deformation of the resin molded product 10 can be suppressed.

Further, in the resin molded product 10 according to the present invention, in the back side of the resin molded product 10, the gate position 40 (or 40S) is provided in the vicinity of the first attaching part 12 on the straight line that connects the first attaching part 12 to the second attaching part 13.

Accordingly, during the molding operation, the resin is assuredly supplied to the rib 14 from the first attaching part 12 and to the second attaching part 13, so that the parallel orientation of the fibers F formed in the rib 14 can be improved.

Further, the rib 14 passes through the main body 11 to stand upright on the back side of the main body 11. At both the sides of the rib 14, the grooves 16 are provided. The rib 14 is formed to be thicker than the main body 11 and the grooves 16.

Accordingly, when the rib 14 is formed, the resin rapidly flows in the rib 14 so that the parallel orientation of the fibers F in the rib 14 may be more improved.

The plurality of auxiliary ribs 15 are provided in directions orthogonal to the extending direction of the rib 14, so that the strength of the resin molded product 10 is increased, a heat resistant deterioration is prevented and durability is improved.

In the above-mentioned exemplary embodiments, the first attaching part 12 and the second attaching part 13 are arranged, however, even when a relation of the arrangement of them is reversed, operations and effects of the present invention are not changed.

Further, in the above-described exemplary embodiments, the gate position 40 (or 40S) is provided in the vicinity of the first attaching part 12 on the straight line that connects the first attaching part 12 to the second attaching part 13, however, even when the gate position is provided in the vicinity of the second attaching part 13 on the straight line that connects the first attaching part 12 to the second attaching part 13, the operations and effects of the present invention are not changed.

This application is based upon and claims the benefit of priority of Japanese Patent Application No. 2011-037345 filed on Feb. 23, 2011, the contents of which are incorporated herein by reference.

The present invention is not limited to the above-described exemplary embodiments, and may be suitably modified or improved. In addition thereto, materials, forms, dimensions, numbers, values, forms, numbers and arranged positions of components respectively in the above-described exemplary embodiments may be arbitrarily employed and are not limited as long as the present invention can be achieved.

What is claimed is:

1. A resin molded product including a plurality of fibers to which a metal heating element is attached, the resin molded product comprising:

a first attaching part that stands upright on a front side of a main body of the resin molded product to attach and fix one part of the metal heating element thereto;

a second attaching part that stands upright on the front side of the main body of the resin molded product to attach and fix another part of the metal heating element thereto, wherein the first attaching part and the second attaching part are directly electrically connected to the metal heating element; and a rib that is extended in an extending direction continuously and integrally from the first attaching part to the second attaching part and stands upright on the front side of the main body and the rib contains the plurality of fibers injected in the resin and extending along the extending direction of the rib;

wherein a gate position is provided in the vicinity between the first attaching part and the second attaching part on a straight line that connects the first attaching part to the second attaching part and also the gate position is provided on a back side of the main body, opposite the front side, so as to set an orientation of the fiber formed in the rib in the extending direction, the gate position corresponding to the location at which resin and the plurality of fibers are injected into a mold to form the resin molded product, wherein the rib protrudes from the front side and the back side; and wherein the metal heating element is a fuse.

2. The resin molded product according to claim 1, wherein the rib passes through the main body and stands upright on the back side of the main body, grooves are provided at both sides of the rib and the rib is formed to be thicker than the main body and the grooves.

3. The resin molded product according to claim 1, wherein a plurality of auxiliary ribs are provided in directions orthogonal to the extending direction of the rib and the auxiliary ribs extend from one side of the main body to another side of the main body.

4. The resin molded product according to claim 1, wherein the rib has a height smaller than a height of the first attaching part and larger than that of the main body.

5. The resin molded product according to claim 1, wherein the rib contains a plurality of fibers along the entire extending direction of the rib and throughout the rib, the fibers being oriented substantially parallel to the extending direction of the rib.

6. The resin molded product according to claim 1, wherein the main body is consists of the plurality of fibers and resin which is molded to the first attaching part, the second attaching part and the rib.

7. The resin molded product according to claim 1, wherein the rib is directly molded to both of the first attaching part and the second attaching part.

8. The resin molded product according to claim 3, wherein the auxiliary ribs entirely extend along a surface of the main body.

* * * * *